US005819872A

United States Patent [19]

Krause

[11] Patent Number: 5,819,872

[45] Date of Patent: Oct. 13, 1998

[54] MOBILE SCAFFOLDING

[75] Inventor: Günther Krause, Alsfeld, Germany

[73] Assignee: Krause-Werk GmbH & Co. KG, Alsfeld-Altenburg, Germany

[21] Appl. No.: 765,829

[22] PCT Filed: May 24, 1995

[86] PCT No.: PCT/EP95/01971

§ 371 Date: Dec. 30, 1996

§ 102(e) Date: Dec. 30, 1996

[87] PCT Pub. No.: WO96/01351

PCT Pub. Date: Jan. 18, 1996

[30] Foreign Application Priority Data

Jul. 1, 1994 [DE] Germany ..... 9410466 U

[51] Int. Cl.[6] ..... E04G 5/00

[52] U.S. Cl. ..... 182/17; 280/763.1

[58] Field of Search ..... 182/12–17, 119; 280/763.1, 766.1

[56] References Cited

U.S. PATENT DOCUMENTS

| | | | |
|---|---|---|---|
| 4,302,023 | 11/1981 | Kiesl | 182/17 |
| 4,967,733 | 11/1990 | Rousseau | 182/13 |
| 5,022,490 | 6/1991 | Wyse | 182/17 |
| 5,152,371 | 10/1992 | Wyse | 182/119 |

FOREIGN PATENT DOCUMENTS

| | | | |
|---|---|---|---|
| 2231235 | 1/1975 | France | 182/119 |

*Primary Examiner*—Alvin C. Chin-Shue

*Attorney, Agent, or Firm*—Flynn, Thiel, Boutell & Tanis, P.C.

[57] ABSTRACT

Mobile scaffoldings must fulfill many different purposes, which, among others, are characterized by variously wide platforms being needed at different distances from structures. An inventive arrangement is adaptable to a degree that it meets many demands. Movable crossbeams changeable on cross-traverses are provided for this purpose in the area of the undercarriage, on which crossbeams are fastened to the posts for the frames connected with the platforms.

11 Claims, 5 Drawing Sheets

MOBILE SCAFFOLDING

FIELD OF THE INVENTION

The invention relates to a mobile scaffolding out of premanufactured structural components essentially comprised of vertical frames assembled out of posts, horizontal, rectangular platforms which can be mounted on crossbars into the frame and can be equipped with openings and defining longitudinal and/or traverse side pieces, which crossbars can, if necessary, also be used as ladder rungs, diagonal longitudinal and/or transverse reinforcements, railing and/or inbetween spars fastened to the posts and extending longitudinally and/or transversely, and rollers for facilitating movement of the scaffolding mounted in pairs on beam-shaped cross-traverses, the distance between the rollers being preferably changable.

BACKGROUND OF THE INVENTION

Scaffoldings of this type have been known for a long time and have proven to be successful because setting up a stationary scaffolding on buildings is in many cases not necessary and is also significantly more expensive. Of course, some special considerations must be given to the construction of mobile scaffoldings of this type.

It is obvious that particular attention must be paid to an easy transport and good stability during use, and pertinent instructions assure that the necessary rigidity of the respective scaffolding is secure and the platforms are safely accessible and can be walked on. Precise instructions are issued for the rollers regarding their stopping ability.

To operate a mobile scaffolding creates considerable problems when the construction operations to be carried out with it requires different scaffolding widths or if work is supposed to be done at different distances from the building on which the work is to be done. On the one hand, several scaffoldings with different widths must then be available because very wide scaffoldings as a rule because of their requirement for larger space are then not desirous when a shorter scaffolding width is sufficient, and, on the other hand, the entire scaffolding including its "undercarriage" must be moved transversely with respect to the normal, longitudinally directed transport direction, which as a rule is to be avoided even when it is demanded that the rollers be provided with swivel-joint brakes.

Therefore, the basic purpose of the invention is to provide a mobile scaffolding of the type identified in detail above with simple means so that the scaffolding width can be easily varied and moreover also the distance of the scaffolding from the building, on which work is to be done, can be changed with few manipulations without requiring a transverse movement.

SUMMARY OF THE INVENTION

The purpose is attained according to the invention by the cross-traverses being constructed continuously, at least, however, in an edge area at its two front ends as a preferably rectangular hollow-section piece in cross section, by the rollers being mounted on preferably rectangular beam pieces, which can be axially guided into the hollow-section pieces of the cross-traverses and can there be supported fixedly against rotation, by one of the beam pieces being fastened rigidly to each cross-traverse, whereas the other beam piece being fastened axially movably in the associated hollow-section piece, and finally by the frames being provided each in the area of the cross-traverse at the point of a transversely extending railing or inbetween spar otherwise possibly provided there at the same length with a crossbeam, which is constructed in each case continuous in cross section as a—preferably rectangular—hollow section, and is arranged axially movable and fixed against rotation on the associated cross-traverse.

Such an arrangement allows the frames on the same cross-traverse can be exchanged, to do so one must merely remove the movable beam piece from the cross-traverse and subsequently mount it again. The entire construction of the cross-traverse and the beam piece fastened thereon including the rollers and their mounting continue to be joined together unchanged. If the cross-traverse is thereby longer than the crossbeam of the frame moved thereon in order to create an optimum distance of the scaffolding from the building on which work is to be done, it is advantageous when the crossbeams can be axially fixable on the associated cross-traverses.

The base of the scaffolding can be significantly enlarged when the rollers are each fastened to a widening traverse, which is supported on the associated beam piece, movable axially parallel or coaxially with respect to same. The rollers are thereby advantageously mounted on the widening traverses in such a manner that a vertical pipe piece is fastened to their outer ends, in which pipe piece a vertical pivot pin connected to a bearing of the associated roller is axially locked and radially movable. The arrangement can thereby be such that the radial mobility of the pivot pin is prevented for a long time and/or a breakable and lockable means prevents rotary movement of the roller. The structural details of the rollers are otherwise not part of the invention and are variable in a wide scope taking into consideration existing regulations.

It is particularly advantageous when the rigidly fastened beam piece is welded to the cross-traverse and/or the axially movably fastened beam piece can be connected to the cross-traverse by means of a screw connection. In this case, the full length of the cross-traverses is then available for the crossbeams movable thereon when the crossbeams are provided with a slot-shaped recess bordering the screw heads of the screw connection, which recess thus effectively receives the screw heads when the respective crossbeam covers also the area of the cross-traverse, which area is used for fastening of the releasable beam piece.

A particularly advantageous design of the invention is characterized in such a manner that below the crossbeam there is provided a short vertical mounting frame fastened thereon on one said crossbeam for mounting a lowermost platform provided near the ground. In this manner, it is possible to fulfill two actually contradictory requirements for a mobile scaffolding of the type defined in the beginning. On the one hand, sufficient space for the rollers and their suspension is supposed to exist so that the needed cross-traverses must have a specific, and not too low height above the ground, and, on the other hand, it is advantageous when the first platform is arranged as close as possible to the ground in order to make stepping in easier. It is understood that the arrangement is best when the cross-traverses are inserted into the frame like the crossbars, in particular when these are also used as ladder rungs.

The invention has many uses when the two cross-traverses are dimensioned such that at least two crossbeams with the associated frames can be provided on said cross-traverses, at least doubling the width of the scaffolding in this manner with otherwise constant frames, platforms and other scaffolding elements. The advantages of the invention are here shown particularly impressively because one single design of a scaffolding equipped in this manner can be changed over with little effort for many different construction tasks, and thus it can eliminate the need to keep several complete systems at one construction site.

Finally the arrangement of the invention permits to further significantly increase the stability of such a scaffolding by providing arms fastenable on the frames for enlarging the base width, and if necessary, elevationally adjustable feet.

As a whole, a transportable scaffolding of the design of the invention is very versatile and can be adapted to many different conditions on location with little work. In spite of this it can have a strudy design and be inherently stable. The structural components, which are used, are—in contrast to the long-used mobile scaffoldings—essentially the same as in stationary scaffoldings so that the manufacture and storage of these parts can be more easily justified than the present state of the art.

BRIEF DESCRIPTION OF THE DRAWINGS

The invention will be discussed in greater detail hereinafter in connection with one exemplary embodiment and the drawings, in which.

DETAILED DESCRIPTION

Figure 1:
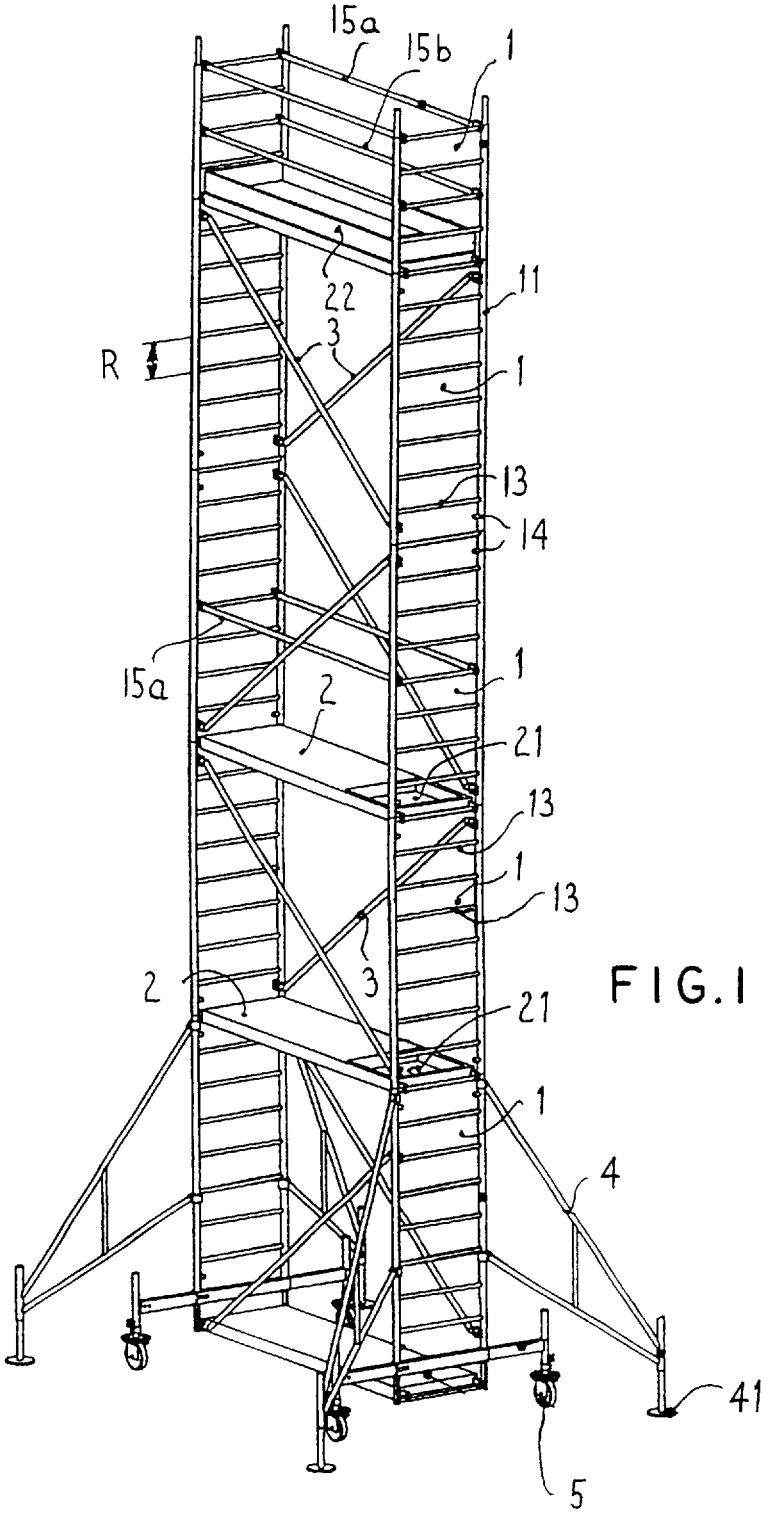
FIG. 1 illustrates a complete view of the scaffolding of the invention.

A mobile scaffolding according to the invention consists, corresponding to FIG. 1, first of all of a system of vertical frames 1 of parallel posts 11, which can be connected to one another, for example, by providing linchpins 12 at their (upper) ends (FIG. 2), onto which the (lower) ends of the next higher posts 11 can be mounted as they usually consist of (circular-cylindrical) pipes. The vertical frames 1 are connected with one another by horizontal platforms 2 which rest on crossbars 13 and are locked to these in a suitable manner. The platforms 2 have, but for one lower platform 2*a,* openings 21 which, if necessary, can also each be closed off by means of a covering plate. The openings 21 make it possible to use the crossbars 13 which are welded to the posts 11 at narrow intervals R, as ladder rungs and eliminates separate steps.

The scaffolding is sufficiently reinforced by means of diagonal longitudinal reinforcements 3. Of course, transverse reinforcements can also be provided, however, which are not needed because of the close sequence of the welded crossbars 13. The longitudinal reinforcements 3 are sometimes fastened to the crossbars 13, however, they are also connected to short brackets 14 which are advantageously shaped just like the crossbars 13 and are welded between the crossbars to the posts 11.

The platforms 2, which are used as work platforms, are for safety reasons surrounded by railing spars 15*a,* also by inbetween spars 15*b*. The platforms 2 can thereby be defined in the foot area by longitudinal and transverse side pieces 22.

A significant enlargement of the base during use of the scaffolding can be achieved when arms 4 are mounted to the frame 1, which arms rest on the ground with elevationally adjustable feet 41. Four arms 4 are, in FIG. 1, diagonally attached to the lower frame 1, however, it is also possible to use fewer arms 4.

This depends in part also on the design of the undercarriage, which consists here of four rollers 5. The rollers 5 essentially enable the mobility of the scaffolding in its longitudinal direction T (FIG. 2) and are supported with a bearing 52 through a pivot pin 51 in a vertical pipe section 16. The pivot pin 51 is designed so as to vertically abut the interior of pipe section 16 and can be locked against rotation so that the axes of the rollers 5 are then aligned transversely to longitudinal direction T, and thus the scaffolding can only be moved in the longitudinal direction T.

Figure 2:
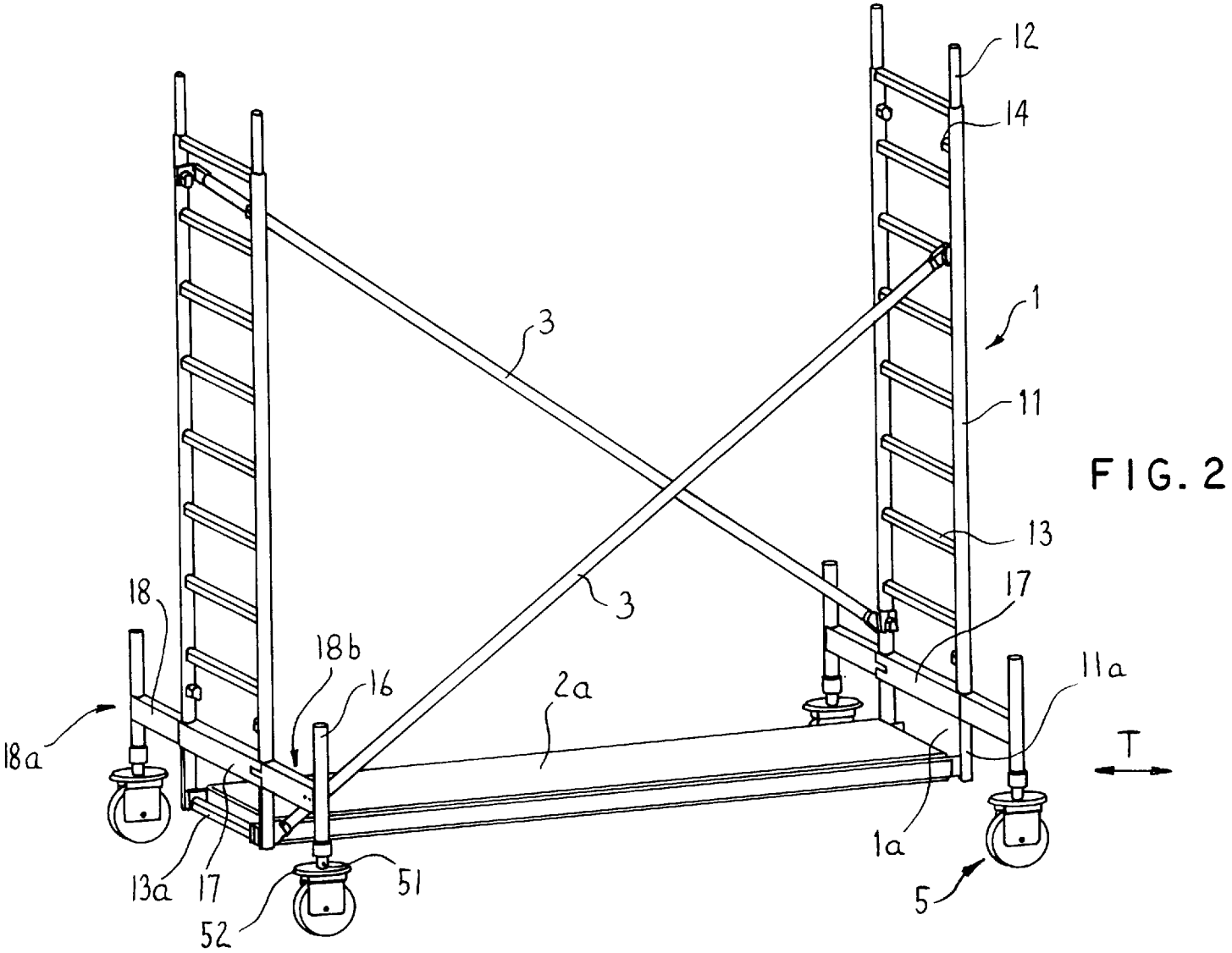
FIG. 2 illustrates a portion of FIG. 1, slightly enlarged, both figures shown as three dimensional views, and FIGS. 3 to 5, each illustrate a detail of FIGS. 1 and 2, all in a schematically simplified illustration.

The crossbars 13 needed in the frames 1 are at the level of the pipe sections 16 replaced with a crossbeam 17, as this can best be seen in FIG. 2, on the underside of which is mounted a short vertical holding frame 1*a* and is welded with its posts 11*a* to the crossbeam 17, the same is used as crossbars 13*a* to secure the platform 2*a* thereto, which in this manner can be arranged just above the ground to enable a comfortable step up and also contributes to the overall rigidity of the scaffolding.

Figure 3:
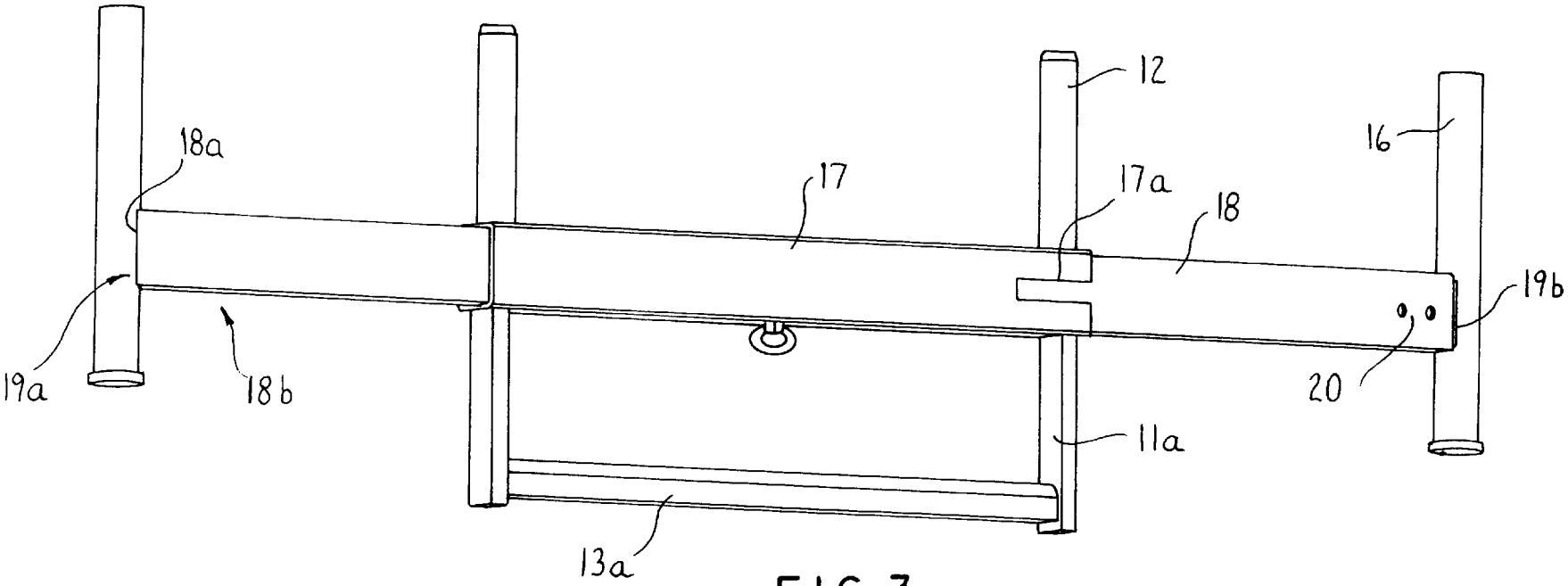
Figure 4:
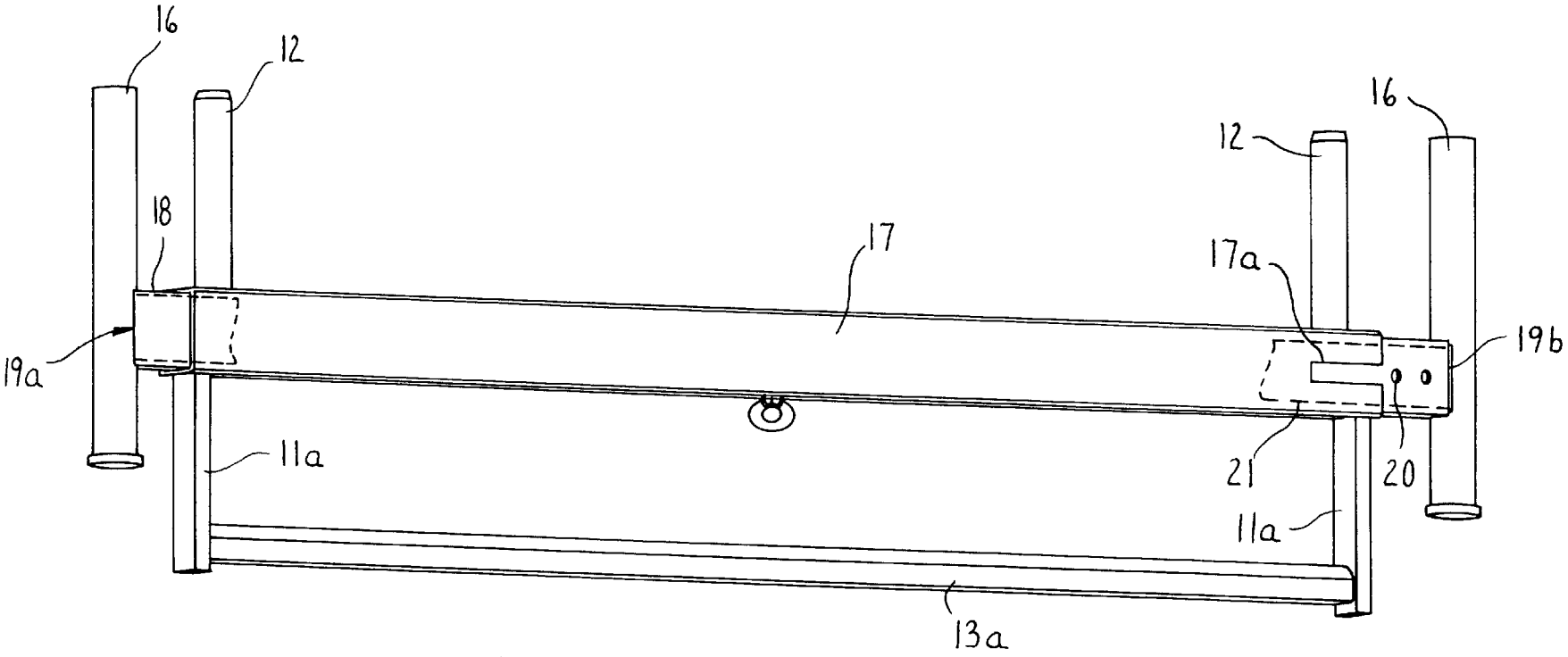
Figure 5:
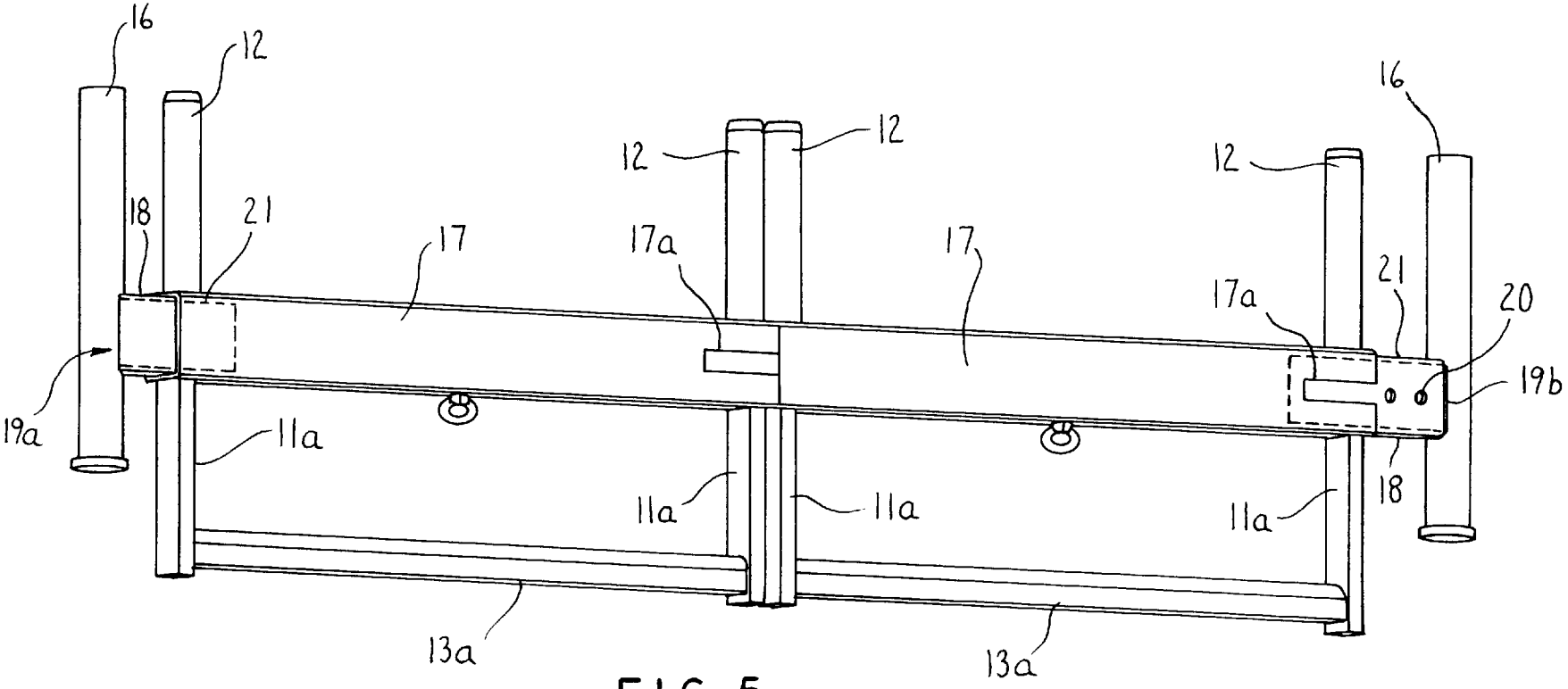

The crossbeam 17 is designed as an (elevationally) rectangular hollow section, which can receive a cross-traverse 18 which is also (elevationally) rectangular in cross section. There are constructed edge areas 18*b* (however, as a rule continuously constructed) each similar in shape to the crossbeam 17 and correspondingly smaller than (elevationally) rectangular hollow-section pieces at least on two front ends 18*a* of the cross-traverse, into which (rectangular) beam pieces 19*a* or 19*b* can be moved (FIGS. 3 to 5). The beam piece 19*a* is rigidly fastened to the cross-traverse 18 and cannot be easily released, whereas the other beam piece 19*b* is axially locked in the associated hollow-section piece simply by means of a screw connection 20. When the crossbeam 17 is supposed to be exchanged with another one (or several others), then it is sufficient to release the screw connection 20. The crossbeams 17 have slot-shaped recesses 17*a* which are designed such that they can also extend over, for example, projecting screw heads of the screw connections 20 so that the cross-traverses 18 are available in their full length for the orientation of the crossbeams 17 thereon.

The beam pieces 19*a,* 19*b* can be connected directly and rigidly to the pipe pieces 16, however, generally a widening traverse 21 which is axially parallel to the cross-traverse 18 is interconnected between these two building components, which widening traverse 21 can be telescopically moved on the respective beam piece 19*a,* 19*b* and is fastened to the associated pipe piece 16, an outline of which is shown in the drawings. They are part of the conventional state of the art and are familiar to the man skilled in the art.

FIGS. 3 to 5 show various embodiments of the association of one and the same cross-traverse 18 to different crossbeams 17. Whereas in FIG. 3 one single crossbeam 17 is mounted, which only uses a portion of the cross-traverse 18 for support and is therefore movable on said cross-traverse so that at an unchanged stationary "undercarriage" the remaining scaffolding is transversely movable to a certain degree. In FIG. 5, two of these crossbeams 17 carrying the frames 1 are mounted one behind the other on the cross-traverse 18, now utilizing their full length. FIG. 4 shows that in place of the two narrow frames, it is also possible to provide one single wide frame. It can be recognized that the invention is not limited to these few examples but that the arrangement is variable in a much wider scope.

I claim:

1. A mobile scaffolding of premanufactured structural components, comprising:

vertical frames assembled out of vertical posts and crossbars extending between the posts;

horizontal, rectangular platforms mounted on the cross-bars of the frames, the platform defining longitudinal and traverse sides of the scaffolding;

means for reinforcing the vertical frames connected between the frames;

first and second of the crossbars respectively defining first and second elongate hollow crossbeams at respective transverse sides of the scaffolding, the first and second crossbeams being connected to two adjacent posts of the respective one of the frames which are at one of the transverse sides of the scaffolding, first and second beam-shaped, elongate cross-traverses respectively slidably received in the first and second crossbeams, the cross-traverses being rectangular and hollow at least in an end area thereof, first and second rectangular beam pieces axially guided respectively into first and second of the hollow areas of each of the cross-traverses, the first and second beam pieces being supported in the respective hollow areas fixed against rotation, the first beam piece being rigidly fixed to the respective cross-traverse in the first hollow area, the second beam piece being fastened axially movable in the second hollow area, and rollers respectively mounted to the first and second beam pieces.

2. The mobile scaffolding according to claim 1, wherein the first and second crossbeams have pins extending therefrom, a lower region of the posts being hollow and receiving respective ones of the pins therein to secure the posts to the crossbeams.

3. The mobile scaffolding according to claim 2, wherein the roller has a bearing, and wherein a vertical pipe section is fastened to the outer ends of each of the beam pieces, the pipe section having a vertical pivot pin connected to the bearing of the roller, the pivot pin being axially locked and radially fixable.

4. The mobile scaffolding according to claim 1, wherein means for selectively axially fixing the crossbeams on the associated cross-traverse is provided.

5. The mobile scaffolding according to claim 1, wherein the first beam piece is welded to the respective cross-traverse.

6. The mobile scaffolding according to claim 1, wherein the second beam piece is connected to the cross-traverse by means of a screw connection.

7. The mobile scaffolding according to claim 6, wherein the crossbeams have a slot-shaped recess bordering the screw heads of the screw connection.

8. The mobile scaffolding according to claim 1, wherein a short vertical mounting frame is fastened on said cross-beams for mounting a lowermost one of the platforms, the lower most platform being provided near the ground.

9. The mobile scaffolding according to claim 1, wherein third and fourth crossbeams are identical to the first and second crossbeams, the first cross-traverse has a length for being received in both the first and third crossbeams and the second cross-traverse has a length for being received in both the second and fourth crossbeams so that the width of the scaffolding is doubled.

10. The mobile scaffolding according to claim 1, wherein elongate arms are provided to widen a support base of the scaffolding, the arms having first ends fastenable to the frames, elevationally adjustable feet are provided at second ends of the arms.

11. A mobile scaffolding of premanufactured structural components, comprising:

at least two vertically-extending frames each comprised of first and second vertical posts and a plurality of crossbars joined between the first and second posts;

at least one horizontally-extending platform positioned between the two frames, the platform being mounted on the crossbars; and a base means for supporting the two frames above a ground surface, the base means comprising: a hollow, elongate first beam connected to the first and second posts of both of the two frames; a hollow, elongate second beam slidably received in the interior of the first beam; first and second beam pieces axially received in the interior of the second beam; and rollers respectively connected to the first ends of first and second beam pieces, the first beam piece having the first end thereof positioned at the first end of the second beam, the first beam piece being fixed against rotational and longitudinal movement in the second beam, a first end of the second beam piece extending outwardly of a second end of the second beam, the second beam piece being fixed against rotational movement in the second beam, the second beam including means for selectively longitudinally fixing the second beam piece in the interior of the second beam so that the second beam piece extends from the second end of the second beam at a select distance.

* * * * *